United States Patent [19]

Herbst et al.

[11] 4,179,821

[45] Dec. 25, 1979

[54] DISHWASHER VENT ARRANGEMENT

[75] Inventors: LeRoy J. Herbst; Thomas E. Jenkins, both of Louisville, Ky.

[73] Assignee: General Electric Company, Louisville, Ky.

[21] Appl. No.: 853,699

[22] Filed: Nov. 21, 1977

[51] Int. Cl.[2] ..... F26B 25/06; B08B 3/10; A47B 81/00; A47B 97/00

[52] U.S. Cl. ..... 34/235; 134/182; 312/213

[58] Field of Search ..... 34/234, 235, 72; 134/104, 154, 182, 183; 312/213; 98/87, 121 R, 121 A

[56] References Cited

U.S. PATENT DOCUMENTS

| | | | |
|---|---|---|---|
| 2,157,943 | 5/1939 | Walker et al. | 98/87 |
| 2,635,941 | 4/1953 | Stoddard | 312/213 |
| 2,752,927 | 7/1956 | Stanitz et al. | 134/182 |
| 2,929,565 | 3/1960 | Gibson | 239/220 |
| 3,024,074 | 3/1962 | Jacobs et al. | 312/213 |
| 3,126,898 | 3/1964 | Duncan | 134/99 |
| 3,170,743 | 2/1965 | Martiniak | 312/213 |
| 3,193,340 | 7/1965 | Braden | 312/213 |
| 3,387,382 | 6/1968 | williamson | 34/72 |
| 3,387,388 | 6/1968 | Williamson | 34/234 |
| 3,588,213 | 6/1971 | Braga et al. | 34/234 X |
| 3,680,940 | 8/1972 | Johansson et al. | 312/213 |
| 3,726,205 | 4/1973 | Miller | 98/121 A |
| 3,876,469 | 4/1975 | Schimke | 134/95 |
| 3,908,681 | 9/1975 | Schimke et al. | 134/94 |

*Primary Examiner*—James Kee Chi

*Attorney, Agent, or Firm*—H. Neil Houser; Radford M. Reams

[57] ABSTRACT

A vent arrangement for dishwashers for venting the hot humid air displaced from the interior of the dishwasher during drying cycles which minimizes the formation of condensate on the exterior surfaces in and about the vent exit opening. The vent exit opening is located in the uppermost region of the dishwasher door and of relatively large area to allow efficient convection drying action, while a plurality of vent exit opening ribs are disposed vertically within the vent exit opening, the vent exit ribs have a particular cross-sectional shape such as to minimize the formation of condensate. The cross-sectional shape includes flange portions laterally extending from a body portion along the frontal edge of each of the vent exit ribs, creating a T-shape to produce an air flow effect minimizing the contact of the vented air with the surface of the ribs and also acting to reduce the thermal mass of the ribs to further minimize condensation. The ribs are formed integrally with a molded plastic vent duct housing, the duct housing also having an upper interior surface and deflector lip configured to direct air flow downwardly as it exits through the opening to reduce condensation on the upper edge. A catch lip extends across the inner edge of the vent duct adjacent the vent exit opening to capture condensate formed on the duct upper surface. The vent exit rib flange shape and vertical disposition recessed within the vent exit opening guide any slight condensate which does form back into the interior of the dishwasher.

14 Claims, 7 Drawing Figures

DISHWASHER VENT ARRANGEMENT

BACKGROUND OF THE INVENTION

1. Field of the Invention

This invention concerns dishwashers and more particularly venting arrangements for allowing the hot moist air generated during the drying cycle of the dishwasher to be vented into the surrounding room air.

2. Description of the Prior Art

Vent openings entering into the interior cabinet space of the dishwashing appliances are often required in order to allow escape of the hot humid air generated within the dishwasher interior and the entrance of relatively dry room air. Such vent openings are often used in conjunction with the drying operation of the dishwasher, particularly in convection type drying in which a heating element located at the bottom of the dishwasher tub heats the interior space, setting up convection currents within the dishwasher interior which ultimately displaces air into the surrounding room air. Such vented hot humid air passing into the much cooler air of the surrounding room space creates a steamy appearance and also condenses moisture on the adjacent surfaces. For this reason, the humid air from within the cabinet dishwasher interior is mixed with heated room air so as to reduce the relative humidity of the air ultimately passed out of the dishwasher via the vent opening. Even though such vented air is reduced in relative humidity, condensation problems still arise on the surfaces about the vent exit opening in immediate proximity to the exterior of the dishwasher. This is particularly aggravated in convection type dishwasher drying arrangements since relatively large openings located within the dishwasher door at the uppermost region are utilized to be most effective in creating efficient convection circulation. Such a large, prominently positioned opening must be suitably treated aesthetically, i.e., a grill or rib structure disposed within the opening which will also serve to prevent the entrance of fingers, objects, etc. from the opening. The presence of such a grill or rib structure within the opening creates relatively large surface areas at the point immediately proximate to the exterior of the dishwasher through which the vent air must pass.

Condensation occurs upon the hot humid air coming into contact with cooler surfaces such as to cool the air to the point where precipitation of the moisture occurs. The presence of condensate is undesirable in appearance and also tends to drip onto the floor immediately in front of the dishwasher, particularly upon opening of the dishwasher door. Such condensation on cooler surfaces is, of course, fundamentally a heat transfer phenomena, the surfaces cooling the hot humid air by conduction. Such conduction of heat and precipitation of moisture is increased with the increasing volume of high temperature and humid air coming into contact with the cooler surfaces. Furthermore, the capacity for the surfaces to act as a cooling heat sink depends on their ability to store large amounts of heat and to conduct the absorbed heat into the surrounding contiguous structures, such as to have the capacity for condensing relatively large quantities of water.

These conditions are met by the rib surfaces and also those exterior surfaces adjacent the upper edges of the vent exit opening since large volumes of the hottest air tends to curl about these exterior surfaces potentially producing considerable condensation.

It is, therefore, an object of the present invention to provide means for minimizing the formation of condensate on vent exit ribs disposed in the vent opening and also along the surfaces adjacent the vent exit opening.

It is another object of the present invention to provide a vent exit rib configuration by which any slight condensation which does form is retained within the interior of the dishwasher, to preclude the escape of the condensate onto the exterior surfaces of the dishwasher or being spilled onto the surrounding floor area.

SUMMARY OF THE INVENTION

These and other objects, which will become apparent upon a reading of the following specification and claims, are accomplished by a venting arrangement including a vent duct means directing vent air through a vent exit opening, with a series of vertical ribs positioned in the vent exit opening. The vent exit rib cross-sectional shape is comprised of a body portion formed with laterally projecting flange portions along the front of the body portion which shape has been found to almost totally eliminate the formation of condensate on the ribs. This, it is believed, occurs as a result of the disruption of the air flow patterns about the ribs to vent the air passing through the vent opening. This greatly reduces the heat transfer from the hot humid vent air into the vent ribs by the creation of stagnant air adjacent the rib surfaces deflecting the bulk of the hottest and most humid air away from the surface areas of the ribs. The vent exit ribs are constructed of light weight plastic material and, while presenting a relatively massive appearance fropm the front of the dishwasher, are of relatively low mass, reducing their capacity to act as heat sinks in absorbing heat from the hot humid air released as the moisture is condensed and the air cooled. The vent duct includes a vent duct housing formed of molded plastic with the ribs integrally therewith. A deflector lip and upper vent duct surface cooperate to direct the air flow downwardly at the point of egress to minimize hot air contact with the exterior surfaces adjacent the upper edge of the vent exit opening, while a catch lip extends across the vent duct adjacent the upper edge to trap any condensate formed on the upper duct surface. A lower inclined baffle is also provided which aids in directing the air downwardly at the vent exit opening, which, taken together with the lateral flange portions and their vertical disposition, serves to guide any slight amounts of condensate which may form back into the interior of the dishwasher. This precludes the escape of condensate onto the exterior surfaces of the dishwasher or onto the surrounding floor area.

Upper interior surfaces through which the vent area passes are lined with a plastic foam material to absorb condensate and reduce the transfer of heat between the hot air and these upper surfaces.

DETAILED DESCRIPTION OF THE PREFERRED EMBODIMENT

In the following specification and claims, certain specific terminology will be utilized for the sake of clarity and a specific embodiment described in accordance with the reuirements of 35 USC 112, but it is to be understood that the same is not intended to be limiting and should not be so construed inasmuch as the invention is capable of taking many forms and variations within the scope of the appended claims.

Figure 1:
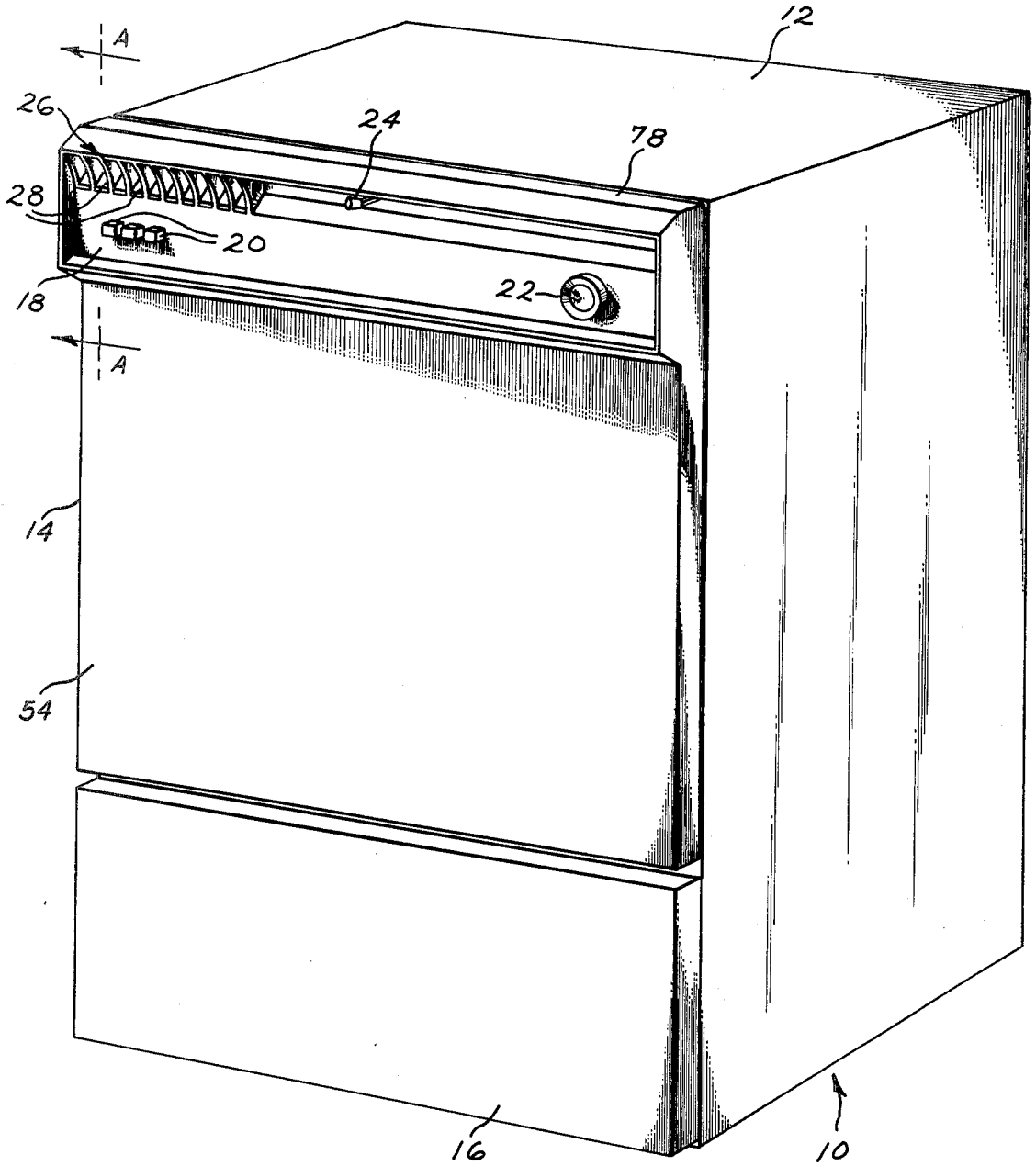
FIG. 1 is a frontal perspective view of a dishwasher incorporating a vent arrangement according to the present invention.

Referring to the drawings and particularly FIG. 1, the dishwasher 10 includes the usual cabinet structure 12 which includes at the front portion thereof a dishwasher door 14 and an access panel 16. The dishwasher door 14 is pivotally mounted so as to be capable of being swung downwardly into the horizontal position so as to provide access to the interior of the dishwasher for loading and unloading of the items to be washed as well as to add detergent and other dishwashing material in the conventional fashion.

The dishwasher door 14 is also provided with a control panel 18 along its upper portion thereof, with the various control buttons 20 and control knob 22 located within the control panel 18. A door latch 24 is also provided to provide means for securing the door in the closed position to prevent leakage due to the escape of high pressure jet sprays normally utilized during washing and rinsing cycles.

Formed within the upper region of the control panel 18 is provided a vent exit opening 26 which is located along the upper region of the front of the dishwasher 10 as shown for the purpose of maximizing the efficiency and effectiveness of convection drying cycle which is contemplated as being employed as will be described hereinafter. Within the vent exit opening 26 is a plurality of generally vertically curved vent ribs 28 which have a pleasing aesthetic appearance and which also act to prevent the entrance of foreign objects, fingers, etc. into the vent opening 26.

Figure 2:
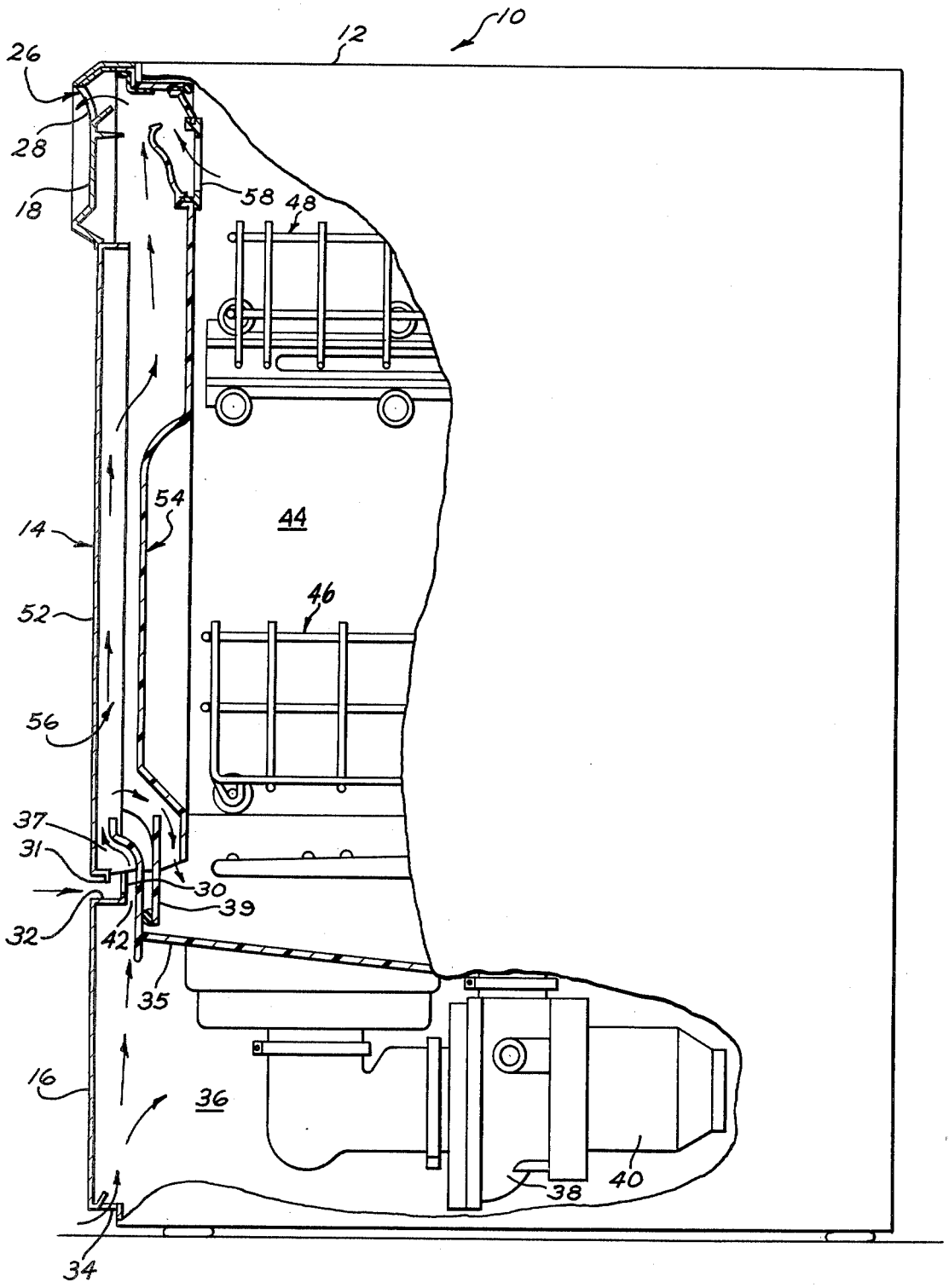
FIG. 2 is a front elevational view of a dishwasher shown in FIG. 1 in partial section of the dishwasher door and tub portions to illustrate a convection air flow path.

Referring to FIG. 2, the convection current air flow paths within the door 14 and the access panel 16. Room air is drawn into the interior chamber 44 of the dishwasher 10 at two differing locations. The first is a clearance gap 30 which exists between the lower edge 31 of the outer door panel 52 and the upper edge 32 of the access panel 16 and also is drawn into a louvered lower opening 34 formed in the lower under surface of the access panel 16. The room air from the lower opening 34 is drawn into the space 36 housing the circulating pump 38, motor 40 and the various other operating components located beneath the dishwasher tub 35. A portion of the air drawn in through the access panel lower louvered opening 34 passes out the upper edge 32 thereof through clearance opening 42 and into a space 37 existing between the tub 35 and outer door panel 52, as does air passing in through the clearance gap 30.

The air drawn into the space 37 passes into the interior space 44 of the dishwasher 10 by flowing around a baffle section 39 of the inner door panel 54, entering the interior space 44 at the lowermost region of the tub 35. Thus, upon rising through the interior space 44, air circulates over both the lower rack 46 and the upper rack 48 thence to the exit 26 as will be described in more detail hereinafter. This rise of intake room air taken in through the clearance passage 30 is created by heating of the air by a drying heater element (not shown) located in the lower portion of the tub 35. Since the tub 35 may be formed of a relatively low melting point plastic, an efficient convection circuit is required to enable the use of lower wattage heating elements as has been conventional to insure tht undue heating of the tub 35 will not occur.

The venting arrangement disclosed with an intake area on the order of 9½ square inches and an exit opening 26 on the order of 6 square inches has been found to provide very efficient convection drying over a wide variety of dishwasher configurations.

The heated air rising through the interior space 44 of the dishwasher 10 causes the room air to be inducted into the clearance space 30 and louvered opening 34 since the heated air is continually being displaced through the vent opening 26 out of the interior space 44 of the dishwasher 10.

In addition to the intake air passing into the interior of the dishwasher 44, a portion of the air drawn into the space 37 passes into the interior space 56 of the dishwasher door 14. Dishwasher doors are normally constructed with a steel outer panel 52 and a typically plastic inner door 54, and the space 56 therebetween provides a flow path for relatively dry air heated by the high temperature existing within the interior of the dishwasher during the drying cycle to likewise rise within the space 56 defined by the outer door 52 and the inner door 54 upwardly. After rising through the space 56, the heated relatively dry air is mixed with the relatively humid air passing out of the interior space 44 after passing over the water-laden items disclosed in the lower and upper racks 46 and 48.

Figure 3:
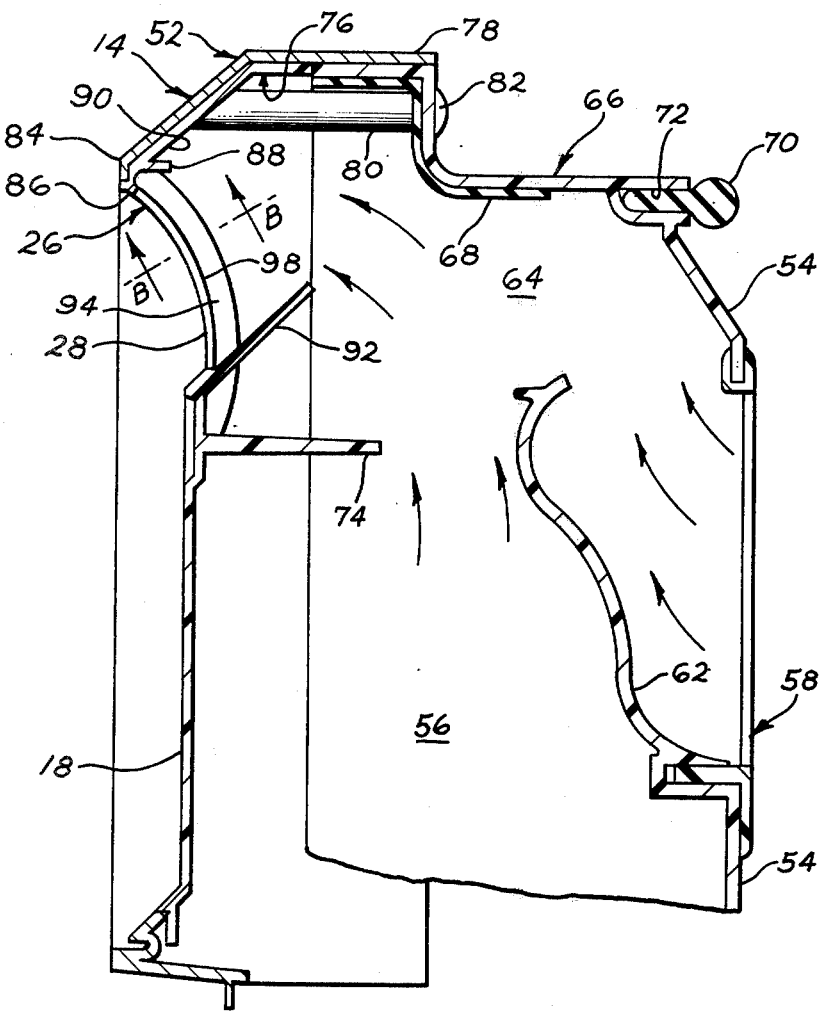
FIG. 3 is a view of the section A—A taken in FIG. 1.

Referring to FIG. 3, the hot humid air received in the interior space 44 passes through an opening 58 formed in the interior door panel 54 opposite the vent opening 26 and co-extensive therewith. Typically, a grid and other controllable splash guard means is provided to close the vent opening 58 during the washing cycle of the dishwasher to prevent escape of the liquid through the vent opening 58. However, since such device does not form a part of the present invention, the details of the same are not hereincluded, although at minimum a grid member would be secured to the opening serving to guide the air flow through the opening.

A molded back splash section 62 is provided opposite the opening 58 which serves to capture any splash passing through the opening 58 and direct the same back to the interior space 44 of the dishwasher. The gradual curvature of the surface presented to the interior of the dishwasher 44 is such as to prevent the accumulation of food particles which may be carried out by the water splash and return the same to the interior without accumulation in the opening 58.

The hot and humid air received from the interior of the dishwasher 44 thence passes into the mixing chamber region 64 located beneath the upper edge of the dishwasher door 14 which also receives the hot dry air flowing upwardly through the interior space 56 to mix with the hot humid air and reduce the relative humidity.

This reduction is relative humidity reduces the tendency for condensate to be formed by the resultant drying of the air passing into contact with the exterior cooler surfaces and the exterior air as is known to those skilled in the art.

Vent duct means are provided for receiving the vented air from the interior space 44 and passing the same through the door 14 and out the vent exit opening 26. This vent duct means includes back splash section 62 and the upper tab portion 66 of the inner door panel 54, received beneath the upper flange 78 of the outer door panel 52. Interior surfaces of the tab portion 66 are covered with a layer 68 of formed plastic or rubber foamed material, which serves to insulate the metal forming the upper surface 66 of the dishwasher door 14 and also serves to absorb any condensate which does form on the heated air coming into contact with the layer.

The door seal 70 is received within a recess 72 formed in the tap portion 66.

A partition section 74 is also included to direct the hot dry air flowing through the interior space 56 so as to guide the same into the interior of the mixing region 64 with the vent duct means to provide a good mixing action between the hot humid air and the hot dry air in the region 64.

The vent duct means also includes a vent duct housing 76 which forms the final passageway for the vent air.

Before discussing the details of the vent duct housing 76, which is formed with the vent ribs 28, a brief discussion of the phenomena of condensation in this context is in order so that the various refinements embodied in the structural details may be fully understood.

As discussed above, the phenomena of condensation is essentially a heat transfer process. That is, heat is transferred from relatively hot air into the cooler surfaces into which it comes into contact. If the heat loss of the air is sufficient to cause precipitation of the moisture from the air, condensation occurs. Obviously, condensation will occur more readily for air which is heavily moisture laden, with a high relative humidity since a relatively slight cooling will then produce some condensation.

The conductive heat transfer from the warm air to the cooler surfaces tends to heat these surfaces as does the release of heat created by the condensing of the water vapor into its liquid phase. This heating will tend to reduce the heat transfer due to the cooling of the air and the heating of the surface to reduce the temperature differential and hence the heat flow from the warm air into the cooler surface. Of course, as the surface recools due to conduction away of the heat absorbed into the adjacent structures, and as a fresh supply of hot humid air moves into contact with the surface, further condensation would occur. It can thus be seen that if the flow of fresh hot humid air immediately adjacent the surface in question can be impeded or disrupted, and further if the heating effect of the surface can be enhanced by reducing the thermal mass available to absorb the heat, and also to conduct the heat into the surrounding structures, condensation could be minimized with respect to such surfaces.

It can be appreciated that the situation most conducive to the condensation process is the presence of a relatively large asurface area which is contacted by relatively large volumes of smooth air flow, such as to maximize the conduction of heat from the air mass into the surface.

Two potentially troublesome surface locations are the exterior surfaces adjacent the upper edge of the vent exit opening 26 and the surfaces of the vent ribs disposed within the opening. The areas adjacent the upper edge are positioned to receive the relatively hot humid air passing into the room air with the heated air tending to curl directly upwardly over these surfaces as it passes into the room. The hottest air would be immediately adjacent the upper edge with the relatively smooth flow due to the low convection flow rates creating a maximum contact of the relatively hot air with the surfaces.

The vent rib structure represents a relative large surface area brought into intimate contact with the air mass by being located across the opening likewise potentially producing a relatively large condensate volume on the surfaces. Both of these locations are located adjacent the exterior of the dishwasher door 14 and allow the condensate to be both visible and also to have a tendency to collect or drip to the exterior of the dishwasher door 14 and access panel 16 and also onto the surrounding floor area.

According to the present embodiment, there is provided a one-piece molded plastic vent structure 76 having a configuration adapted to mate with vent exit opening 26, and secured within the door 14 by means of molded pedestals 80 secured to the flange portion 78 by means of machine screws 82. The vent duct housing 76 is formed with a corresponding shape to mate with the vent exit opening 26 and thus direct air flow therethrough to the exterior of the dishwasher 10.

The vent duct housing 76 has a configuration such as to correct the tendency for condensate to collect along the front surface 84 of the dishwasher door 14 adjacent the upper edge of the vent exit opening 26. This configuration includes a deflector lip 86 which extends below the level of the vent opening 26, formed within the vent duct housing 76. Catch lip 88 formed along the length of the vent opening 26 also serves to disrupt the air flow patterns occurring about the upper portion of the vent duct housing 76 and also to collect any condensate which does form along the inner surface 90 of the vent duct housing 76.

As a further aid to correcting this tendency, as inclined baffle 92 is also provided which cooperates with the vent duct inner surface 90 serving to guide the air flow in a downward direction through the vent opening 26 such as to create a downward momentum in the air flow, thus defeating the tendency towards smooth flow around the front edge 84. The baffle 92 further contributes to a deflection of the hot dry air flowing through the interior space 56, insuring intimate admixture with the hot humid air in the mixing region 64.

Thus, the air mass egresses from the vent opening 26 with a slight downward momentum and the disruptive effect of the deflector lip 86 and catch lip 88 further precluding any smooth fluid contact with upper edge 84.

Figure 4:
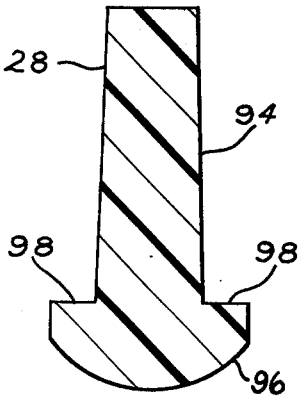
FIG. 4 is a view of the section B—B through a representative vent rib to illustrate the cross sectional shape.

The vent exit ribs 28 are formed integrally with the vent duct housing 76, a plurality of which are disposed across the vent opening 26 from top to bottom as to be disposed in a generally vertical direction. Each of the vent exit ribs 28 (as seen in FIG. 4) is formed with a central body portion 94 which terminates in a relatively wider smoothly curved exterior frontal surface 96 with at least one lateral projection 98 extending along the front portion of each of the vent exit ribs 28.

The lateral projections 98 provide an approximate T-shaped c-sectional shape section which has been found to almost completely eliminate any tendency to form condensate. While the precise reason for this result is not known with absolute certitude, it appears reasonable to conclude that the disruption of the air flow as it passes about the surfaces of the vent exit ribs 28 reduces the contact of the relatively hot air passing through the vent opening 26 and produces relatively cooled air immediately adjacent the surfaces of the vent exit rib 28 which would act to insulate the relatively hot air in the main stream of flow through the vent opening 26 preventing it from coming into contact with the surfaces of the vent ribs 28.

In addition, the molded plastic construction of the housing of each of the vent ribs 28 being rather poor conductors of heat, reduces the transfer of heat into the rest of the vent duct housing 76 and dishwasher door 14, allowing the vent exit ribs 28 to be warmed by the passage of vent air to minimize the temperature differential therebetween.

The thermal mass of the vent ribs 28 is relatively low by virtue of the relatively thin body section 94 presenting a rather massive effect from the front due to the presence of the wider frontal section 96. Similarly, the mass of the rib structure available as a heat sink is lessened to limit the absorbing of heat conducted thereinto by contact with the hot air and condensation of the water vapor. That is to say, a relatively slight quantity of heat will be required to raise the vent exit rib 28 temperature to the point where heat transfer becomes insignificant. All of these factors would appear to constitute a reasonable explanation for the resultant almost entire elimination of condensation from the vent exit rib surfaces.

The laterally projecting portions 98 provide another important function in that they provide an invisible guide path for directing any condensate which forms along the interior surface of the vent exit ribs back into the interior of the dishwasher by virtue of the vertical disposition of the vent exit ribs 28 and their being recessed within the vent exit opening 26, such that the slight amount of condensate that may occur will not be visible and will not have a tendency to drip onto the exterior surfaces and floor adjacent the dishwasher 10. The T-shaped section also affords relatively high strength construction resistant to breakage by virtue of its superior rigidity to bending.

Figure 5:
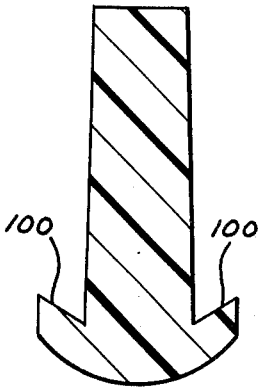
FIGS. 5, 6 and 7 show alternate embodiments of the rib cross-sectional configurations.
Figure 7:
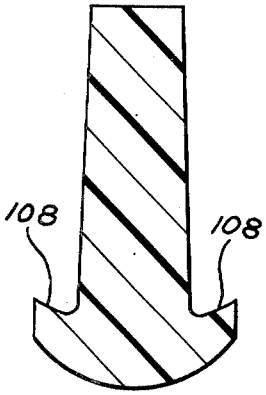
Figure 6:
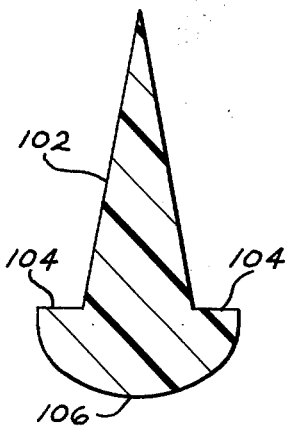

FIGS. 5, 6 and 7 are other forms of the T-section, all of which will afford the same advantages.

In FIG. 5, the lateral projections are curved rearwardly while in FIG. 6, the body section 102 has a tapered wedge shaped section with similar lateral projections 104 forming the relatively massive front section 106.

In FIG. 7, the lateral projections 108 are curved to the rear rather than merely angled to the rear as in the embodiment shown in FIG. 5.

Accordingly, it can be appreciated that the arrangement provided by the present invention allows the use of frontally located vent openings having relatively large openings such as to require grill elements to be disposed within the openings without creating a condensate problem. Further, the tendency for condensate to form along the upper edge has also been obviated to allow the use of an efficient convection flow drying cycle. This has been accomplished by a construction which is simple and low in cost, while being aesthetically quite pleasing.

What is claimed is:

1. In a dishwasher of the type having an interior space for enclosing dish holding racks and further having heating means utilized in a drying cycle, heating the air within the interior space, the improvement comprising a venting arrangement venting the relatively hot humid air from the interior chamber of said dishwasher during said dish drying cycle, said vent arrangement including:

vent duct means receiving heated air displaced from the interior chamber of said dishwasher;

a vent exit opening, directing heated air received from said vent duct means to the exterior of said dishwasher; and a plurality of vent exit ribs disposed across said vent exit opening, each of said vent exit ribs having a body portion extending across said vent exit opening, and at least one laterally projecting flange portion formed along the length of said body portion, whereby flow of said heated air about said vent ribs in passing through said vent exit opening is disrupted to minimize the formation of condensate thereon.

2. The dishwasher venting arrangement according to claim 1 wherein said vent exit opening is located on a frontal surface of said dishwasher.

3. The dishwasher venting arrangement according to claim 1 wherein each of said vent exit ribs is formed with a plurality of laterally projecting portions extending along the length of said body portions whereby said vent exit ribs have a generally T-shaped cross-sectional shape.

4. The dishwasher venting arrangement according to claim 3 wherein said laterally projecting portions are disposed along said body portions adjacent the exterior of said vent exit opening, whereby said vent exit ribs present a relatively massive appearance viewed from the front of the dishwasher.

5. The dishwasher venting arrangement according to claim 4 wherein said vent exit opening is located on a frontal surface of said dishwasher.

6. The dishwasher venting arrangement according to claim 5 wherein said dishwasher includes a frontally located door, and wherein said vent exit opening is located in the upper region of said door.

7. The dishwasher venting arrangement according to claim 1 wherein said vent duct means includes a molded plastic vent duct housing, and wherein said exit vent ribs are integral with said vent duct housing.

8. The dishwasher venting arrangement according to claim 1 wherein said vent ribs are recessed within said vent exit opening and extend across said vent opening from the top to the bottom of said vent opening whereby condensate forming on said vent exit ribs is guided on the surfaces of said vent exit ribs back into the interior of said dishwasher.

9. The dishwasher venting arrangement according to claim 8 wherein said vent exit ribs are curved along their length.

10. The dishwasher venting arrangement according to claim 1 wherein said vent duct means includes a deflector lip extending across an upper edge of said vent exit opening, deflecting flow away from said edge.

11. The dishwasher venting arrangement according to claim 1 wherein said vent duct means includes an upper duct surface disposed to direct air flow downwardly as it flows through said vent exit opening, whereby air flow contact with the surface of said dishwasher exterior adjacent the upper edge of said vent exit opening is minimized to minimize the formation of condensate on said exterior surface.

12. The dishwasher venting arrangement according to claim 11 wherein said vent duct means further includes a baffle extending across said vent duct means adjacent the lower edge of said vent exit opening and inclined upwardly to receive air flow and to direct said air flow downwardly to augment the effect of said upper duct surfaces.

13. The dishwasher venting arrangement according to claim 11 further including a catch lip extending across said vent duct means adjacent to said upper edge of said vent exit opening position to catch condensate forming on said upper duct surface.

14. The dishwasher venting arrangement according to claim 13 further including thermal insulating and moisture absorbent material affixed to said portions of said vent duct means surface, whereby condensation thereon is minimized and any condensate forming thereon is absorbed.

* * * * *